US009429976B2

(12) United States Patent
Taguchi

(10) Patent No.: US 9,429,976 B2
(45) Date of Patent: Aug. 30, 2016

(54) VEHICLE OPERATION PEDAL DEVICE

(75) Inventor: Nozomu Taguchi, Toyota (JP)

(73) Assignee: Toyoda Iron Works Co., Ltd., Toyota-shi, Aichi (JP)

( * ) Notice: Subject to any disclaimer, the term of this patent is extended or adjusted under 35 U.S.C. 154(b) by 0 days.

(21) Appl. No.: 14/369,209

(22) PCT Filed: Jul. 5, 2012

(86) PCT No.: PCT/JP2012/067236

§ 371 (c)(1),
(2), (4) Date: Jun. 27, 2014

(87) PCT Pub. No.: WO2013/099330

PCT Pub. Date: Jul. 4, 2013

(65) Prior Publication Data

US 2014/0352484 A1 Dec. 4, 2014

(30) Foreign Application Priority Data

Dec. 28, 2011 (JP) ..... 2011-288790

(51) Int. Cl.

| | |
|---|---|
| ***G05G 1/30*** | (2008.04) |
| ***G05G 1/44*** | (2008.04) |
| ***G05G 5/05*** | (2006.01) |

(52) U.S. Cl.

CPC *G05G 1/44* (2013.01); *G05G 1/30* (2013.01); *G05G 5/05* (2013.01); *Y10T 74/20528* (2015.01)

(58) Field of Classification Search

CPC ..... B60T 7/04; B60T 7/06; B60T 11/08; G05G 1/30; G05G 1/44; Y10T 74/20528; Y10T 74/20888

See application file for complete search history.

(56) References Cited

U.S. PATENT DOCUMENTS

| | | | | |
|---|---|---|---|---|
| 7,069,810 | B2 * | 7/2006 | Hayashihara | 74/512 |
| 2010/0186540 | A1 | 7/2010 | Sugiura et al. | |

FOREIGN PATENT DOCUMENTS

| | | | | |
|---|---|---|---|---|
| DE | 4025157 | A1 * | 2/1992 | B60T 7/06 |
| WO | WO 2010/073347 | A1 | 7/2010 | |

* cited by examiner

*Primary Examiner* — Thomas Diaz

(74) *Attorney, Agent, or Firm* — Finnegan, Henderson, Farabow, Garrett & Dunner, LLP

(57) ABSTRACT

In a vehicle operation pedal apparatus, an engagement hook is formed in one end portion of a return spring, an engagement hole or cutout into which the engagement hook is hooked is formed in a bracket plate member disposed on an operation pedal, and a surface direction of a portion of the bracket plate member, in which the engagement hole or cutout is formed, is set such that a contact point at which the engagement hook contacts one of a pair of edges that are ridgelines between an inner wall surface of the engagement hole or cutout and one surface and an other surface of the bracket plate member is a relative pivot point of the return spring that pivots relative to the operation pedal in accordance with a pivoting operation of the operation pedal in an entire operation angle range of the operation pedal.

3 Claims, 8 Drawing Sheets

VEHICLE OPERATION PEDAL DEVICE

CROSS-REFERENCE TO RELATED APPLICATIONS

This application is a national phase application of International Application No. PCT/JP2012/067236, filed Jul. 5, 2012, and claims the priority of Japanese Application No. 2011-288790, filed Dec. 28, 2011, the content of both of which is incorporated herein by reference.

TECHNICAL FIELD

The invention relates generally to a vehicle operation pedal apparatus, and more specifically to a technique for preventing abnormal noise from being generated by a return spring held under tension in order to return an operation pedal in the vehicle operation pedal apparatus.

BACKGROUND ART

As one kind of vehicle operation pedal apparatus such as a brake pedal or a clutch pedal, there has been known an apparatus including (a) an operation pedal supported by a pedal support member so as to be pivotable about one axis, and (b) a return spring having one end portion engaged with a bracket plate member disposed on the operation pedal and the other end portion engaged with a position fixing member, in which (c) the operation pedal is returned to an original position in accordance with an urging force of the return spring upon cancellation of a depressing operation of the operation pedal. Such an apparatus is described in, for example, Patent Document 1.

RELATED ART DOCUMENT

Patent Document

Patent Document 1: WO2010/073347A1

SUMMARY OF THE INVENTION

Problem to be Solved by the Invention

In the above-described vehicle pedal apparatus, abnormal noise may be generated, in response to a pivoting operation of the operation pedal, from the return spring held under tension between the bracket plate member disposed on the operation pedal and the position fixing member, the return spring being disposed to urge the operation pedal toward the original position.

The invention is made in the light of the above-described circumstances, and an object of the invention is to provide a vehicle operation pedal apparatus configured to prevent abnormal noise from being generated by a return spring during a pivoting operation of an operation pedal.

Means for Solving the Problem

The present inventor has repeated various analyses and investigations in consideration of the above-described circumstances, and has eventually reached a fact described below. That is, in the conventional vehicle operation pedal apparatus described in, for example, Patent Document 1, as illustrated in FIG. 9, one end portion of a return spring 100 has an engagement hook 100*a* formed by bending an end portion of a wire rod constituting the return spring 100, an engagement hole 102*a* into which the engagement hook 100*a* is hooked is formed in a bracket plate member 102 disposed on the operation pedal so as to pass through the bracket plate member 102, and the engagement hole 102*a* is formed so as to pass through the bracket plate member 102 in a direction perpendicular to one surface 102*b* and the other surface 102*c* of the bracket plate member 102. Further, one of a pair of edges ED1, ED2 that are ridgelines between an inner wall surface of the engagement hole 102*a* and the one surface 102*b* and the other surface 102*c* of the bracket plate member 102 is brought into contact with the engagement hook 100*a*.

In this type of vehicle operation pedal apparatus, states of the return spring 100 from when the operation pedal is depressed and a pedal stroke becomes maximum until when the depression of the operation pedal is cancelled and the pedal stroke becomes zero are as sequentially illustrated in FIG. 9. As illustrated in FIG. 9, when the pedal stroke is maximum, an angle θ between the direction of the one surface 102*b* of the bracket plate member 102 and a line L of action of the return spring 100, which passes through a contact point P1 at which the engagement hook 100*a* is in contact with the edge ED1, that is, a contact angle θ takes a positive value. Further, when the pedal stroke is minimum, that is, zero, a contact angle θ between the direction of the other surface 102*c* of the bracket plate member 102 and the line L of action of the return spring 100, which passes through a contact point P2 at which the engagement hook 100*a* is in contact with the edge ED2, takes a negative value. With regard to the contact angle θ, the above-mentioned positive value indicates that the line L of action of the return spring 100 tilts in the counterclockwise direction about the contact point P1, P2 with respect to the one surface 102*b* or the other surface 102*c* of the bracket plate member 102, and the above-mentioned negative value indicates that the line of action tilts in the clockwise direction about the contact point P1, P2. Further, the line L of action is a line indicating the direction in which the urging force of the return spring 100 acts.

In the conventional vehicle operation pedal apparatus configured as described above, as illustrated in FIG. 9 and FIG. 10, in the returning direction of the above operation pedal, a friction force which has acted between the edge ED1 of the engagement hole 102*a* formed in the bracket plate member 102 and the hook 100*a* of the return spring 100 is reduced as the contact angle θ decreases, and slip is generated at the hook 100*a* that is in contact with the edge ED1 due to a reaction force of the return spring 100. Subsequently, the contact angle θ is inverted from a positive value to a negative value, and the hook 100*a* may be brought into contact with the edge ED2. As described above, in the course of a pivoting operation of the operation pedal, discontinuous slip is generated at the hook 100*a* that is in contact with the edge ED1, so that contact noise may be generated by abrupt slip, or the hook 100*a* may be dragged along the edge ED1 and vibrate. Then, there has been found the fact that the return spring 100 excited by the vibration resonates at a vibration frequency close to a natural vibration frequency thereof, so that abnormal noise is generated from the return spring 100. The invention is made on the basis of this finding.

That is, the invention provides a vehicle operation pedal apparatus comprising (a) an operation pedal supported by a pedal support member so as to be pivotable about one axis, and (b) a return spring having one end portion engaged with a bracket plate member disposed on the operation pedal and the other end portion engaged with a position fixing member, wherein (c) the operation pedal is returned by pivoting in accordance with an urging force of the return spring upon cancellation of a depressing operation of the operation pedal, the vehicle operation pedal apparatus characterized in that: (d) an engagement hook is formed in the one end portion of the return spring by bending an end portion of a wire rod that constitutes the return spring; (e) an engagement hole or cutout into which the engagement hook is hooked is formed in the bracket plate member disposed on the operation pedal so as to pass through the bracket plate member; and (f) a surface direction of a portion of the bracket plate member, in which the engagement hole or cutout is formed, is set such that a contact point at which the engagement hook contacts one of a pair of edges that are ridgelines between an inner wall surface of the engagement hole or cutout and one surface and the other surface of the bracket plate member is a relative pivot point of the return spring that pivots relative to the operation pedal in accordance with a pivoting operation of the operation pedal in an entire operation angle range of the operation pedal.

Effect of the Invention

In the vehicle operation pedal apparatus according to the invention, the surface direction of the portion of the bracket plate member, in which the engagement hole or cutout is formed, is set such that the contact point at which the engagement hook contacts the one edge in the pair of the edges, which are the ridgelines between the inner wall surface of the engagement hole or cutout and the one surface and the other surface of the bracket plate member, is the relative pivot point of the return spring that pivots relative to the operation pedal in accordance with the pivoting operation of the operation pedal in the entire operation angle range of the operation pedal. Thus, during the pivoting operation of the operation pedal, the contact point at which the engagement hook of the return spring contacts the bracket plate member does not shift from the one edge to the other edge in the pair of the edges in the engagement hole or cutout, and hence discontinuous slip is not generated between the engagement hook and the bracket plate member. Thus, it is possible to reliably prevent generation of contact noise that is generated due to abrupt slip, or generation of abnormal noise from the return spring.

Preferably, the engagement hole or cutout is formed so as to pass through the bracket plate member in a direction perpendicular to the one surface of the bracket plate member; and an angle between the surface direction of the portion of the bracket plate member, in which the engagement hole or cutout is formed, and a line of action of the return spring, which passes through the contact point, takes a positive value in the entire operation angle range of the operation pedal, or takes a negative value in the entire operation angle range of the operation pedal. Thus, the angle does not shift from one angle to the other angle, which has a positive value or a negative value across zero, and the contact point is maintained. Therefore, an angle change of the line of action of the return spring along with discontinuous slip of the engagement hook is prevented from being inverted from a positive value to a negative value or from a negative value to a positive value, and thus generation of abnormal noise from the return spring during the pivoting operation of the operation pedal is reliably prevented.

MODES FOR CARRYING OUT THE INVENTION

Hereinafter, an embodiment of the invention will be described in detail with reference to the drawings. Note that, in the following embodiments, the drawings will be simplified or deformed as needed to facilitate understanding of the drawings, and the dimensional ratio, the shape and the like of each portion will not be always drawn accurately.

Embodiment 1

Figure 1:
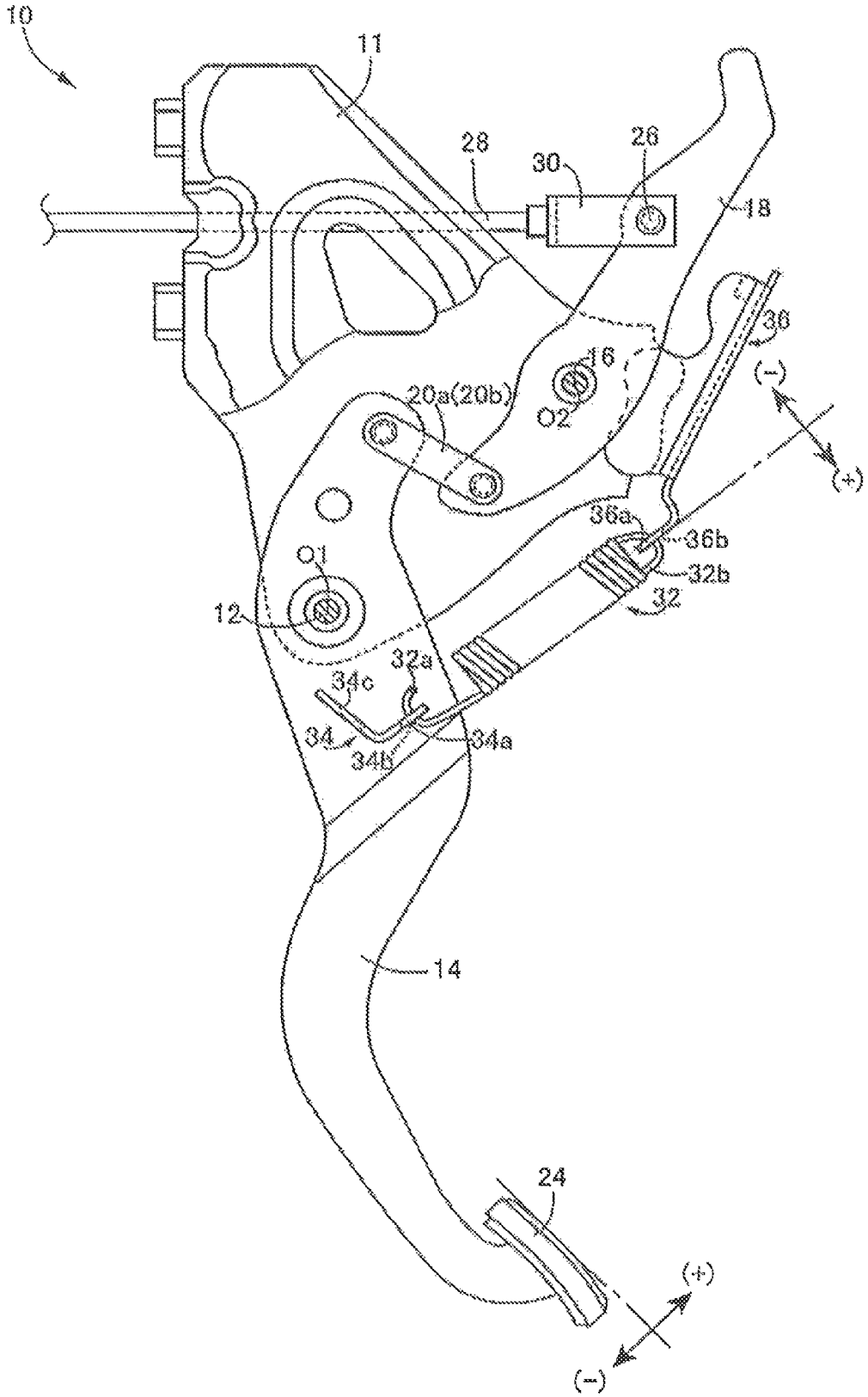
FIG. 1 is a front view of a brake pedal apparatus (vehicle operation pedal apparatus), to which the invention is applied.

FIG. 1 is a front view of a brake pedal apparatus (vehicle operation pedal apparatus) 10 for a service brake, to which the invention is applied. The brake pedal apparatus 10 includes: a position fixing pedal support (pedal support member) 11 fixedly fitted to a vehicle body; an elongate operation pedal 14 supported by the pedal support 11 so as to be pivotable about an axis (one axis) O1 of a horizontal first support shaft 12; an elongate pivot member 18 supported by the pedal support 11 so as to be pivotable about an axis O2 of a second support shaft 16, the axis O2 being parallel to the axis O1; and a pair of connection links 20*a*, 20*b* provided between the operation pedal 14 and the pivot member 18 such that the operation pedal 14 and the pivot member 18 are interposed between the connection links 20*a*,

20*b* disposed on both sides (front and back sides of FIG. 1) of the operation pedal 14 and the pivot member 18, thereby connecting the operation pedal 14 and the pivot member 18 to each other. FIG. 1 is a view in which a front-side side plate of the pedal support 11 is partially cut out so that portions connected by the connection links 20*a*, 20*b* are visible.

When a pedal sheet 24 disposed at a lower end portion of the operation pedal 14 is depressed by a driver, the operation pedal 14 is operated to pivot clockwise about the first support shaft 12 in FIG. 1, thereby pivoting the pivot member 18 counterclockwise about the second support shaft 16 via the connection links 20*a*, 20*b* connected to an upper end portion of the operation pedal 14. A pushrod 28 is connected via a clevis 30 to an upper end portion of the pivot member 18 so as to be pivotable relative to the pivot member 18 about an axis of a connection pin 26 that is substantially parallel to the second support shaft 16. With the pivot motion of the pivot member 18, the pushrod 28 is mechanically pushed leftward in FIG. 1, so that a brake hydraulic pressure corresponding to a depressing operation force applied to the operation pedal 14 is generated. The pushrod 28 is urged to project rearward from a brake master cylinder (not illustrated) or a brake booster disposed on the brake master cylinder, and a return spring 32, which is a coil spring, is held under tension between the operation pedal 14 and the pedal support 11. Thus, when the depressing operation of the pedal sheet 24 is cancelled, the pivot member 18 is returned by pivoting clockwise about the axis O2 of the second support shaft 16 by an urging force of the pushrod 28 and the return spring 32, and the operation pedal 14 is returned by pivoting counterclockwise about the axis O1 of the first support shaft 12 to be returned to an original position illustrated in FIG. 1.

Figure 2:
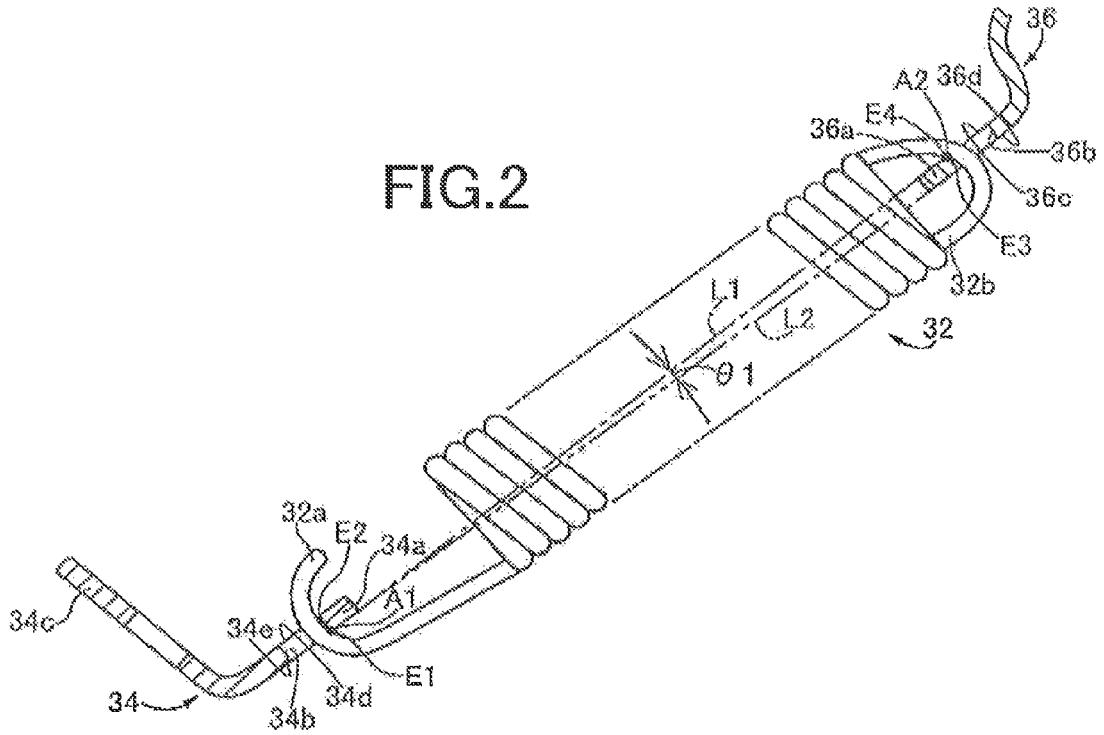
FIG. 2 is a view of a return spring held under tension in the brake pedal apparatus of FIG. 1.

As illustrated in FIG. 1 and FIG. 2, the return spring 32 is obtained by winding one spring wire rod having, for example, a circular cross-section into a coil form, and opposite end portions of the wire rod respectively have a pair of engagement hooks 32*a*, 32*b* formed by bending the end portions of the wire rod into a circular-arc shape. A bracket plate member 34 formed by pressing, for example, a flat metal plate into an L-shape is fixed integrally with an intermediate portion of the operation pedal 14 by spot welding or the like, and a circular engagement hole (hole for engagement) 34*b* into which the engagement hook 32*a* is hooked is formed in a flat first plate portion 34*a* of the bracket plate member 34, the first plate portion 34*a* being located on the return spring 32 side, so as to pass through the first plate portion 34*a* in a direction perpendicular to the plate surface. A cushion material that is brought into contact with a position fixing stopper (not illustrated) during returning pivot motion of the operation pedal 14 may be fixed to a flat second plate portion 34*c* which is located on the opposite side of the bracket plate member 34 from the first plate portion 34*a*. Further, the pedal support 11 is provided with a spring engagement member 36, which is a position fixing member fixed integrally with the pedal support 11 by, for example, spot welding, and the spring engagement member 36 is provided integrally with a flat engagement plate portion 36*a* extended toward the return spring 32, which is formed by bending a flat metal plate by press working. A circular engagement hole 36*b* into which the engagement hook 32*b* is hooked is formed in the engagement plate portion 36*a* so as to pass through the engagement plate portion 36*a*.

As illustrated in FIG. 2 in detail, the first plate portion 34*a* is in the form of a flat plate having one surface 34*d* on the first support shaft 12 side and the other surface 34*e* on the pedal sheet 24 side, which are parallel to each other, and the engagement hole 34*b* of the bracket plate member 34 is formed so as to pass through the first plate portion 34*a* in a direction perpendicular to the one surface 34*d* and the other surface 34*e*. Further, the engagement plate portion 36*a* of the spring engagement member 36 is in the form of a flat plate having one surface 36*c* on the second support shaft 16 side and the other surface 36*d* on the pedal sheet 24 side, which are parallel to each other, and the engagement hole 36*b* formed in the engagement plate portion 36*a* passes through the engagement plate portion 36*a* in a direction perpendicular to the one surface 36*c* and the other surface 36*d*.

Out of the pair of engagement hooks 32*a*, 32*b* respectively formed at the opposite ends of the return spring 32, the engagement hook 32*b* on the spring engagement member 36 side is closed, and attached in advance so that the engagement hook 32*b* is not removed from the engagement hole 36*b* of the spring engagement member 36. Out of the pair of engagement hooks 32*a*, 32*b*, the engagement hook 32*a* on the bracket plate member 34 side is open, and is hooked into the engagement hole 34*b* during the assembly. A portion of the engagement hook 32*b*, which includes a contact point A2 with respect to the engagement hole 36*b*, is bent in an arc-shape having a curvature radius larger than that of a portion of the engagement hook 32*a*, which includes a contact point A1 with respect to the engagement hole 34*b*. As described above, in the engagement hook 32*b*, the portion including the contact point A2 with respect to the engagement hole 36*b* has the arc-shape having a large curvature radius, and hence the contact point A2 with respect to the engagement hole 36*b* is not moved in the entire range of pivot motion of the operation pedal 14 and discontinuous slip is not generated between the engagement hook 32*b* and the spring engagement member 36.

The engagement hook 32*a* of the return spring 32 is in contact with one edge E1 in a pair of edges E1, E2 that are ridgelines between an inner wall surface of the engagement hole 34*b* and the one surface 34*d* and the other surface 34*e* of the first plate portion 34*a* in the bracket plate member 34. Further, the engagement hook 32*b* is in contact with one edge E4 in a pair of edges E3, E4 of ridgelines between an inner wall surface of the engagement hole 36*b* and the one surface 36*c* and the other surface 36*d* of the engagement plate portion 36*a* in the spring engagement member 36.

Further, an angle θ1 between the direction of the other surface 34*e* of the first plate portion 34*a* of the bracket plate member 34 and a line L1 of action of the return spring 32, which passes through the contact point A1 at which the edge E1 and the engagement hook 32*a* contact each other, that is, a contact angle θ1 takes a positive value, that is, $\theta 1 > 0°$. Note that a positive value of the contact angle θ1 indicates that the line L1 of action of the return spring 32 tilts about the contact point A1 in the counterclockwise direction with respect to the other surface 34*e* of the first plate portion 34*a* of the bracket plate member 34. Further, the line L1 of action is a line that connects engagement points of both end portions of the return spring 32 to each other, that is, connects the contact point A1 to the contact point A2 at which the edge E4 and the engagement hook 32*b* contact each other. That is, the line L1 of action indicates a direction in which an urging force of the return spring 32 acts. Further, in FIG. 2, the surface direction of the other surface 34*e* of the first plate portion 34*a* is indicated by a two-dot chain line L2.

Figure 3:
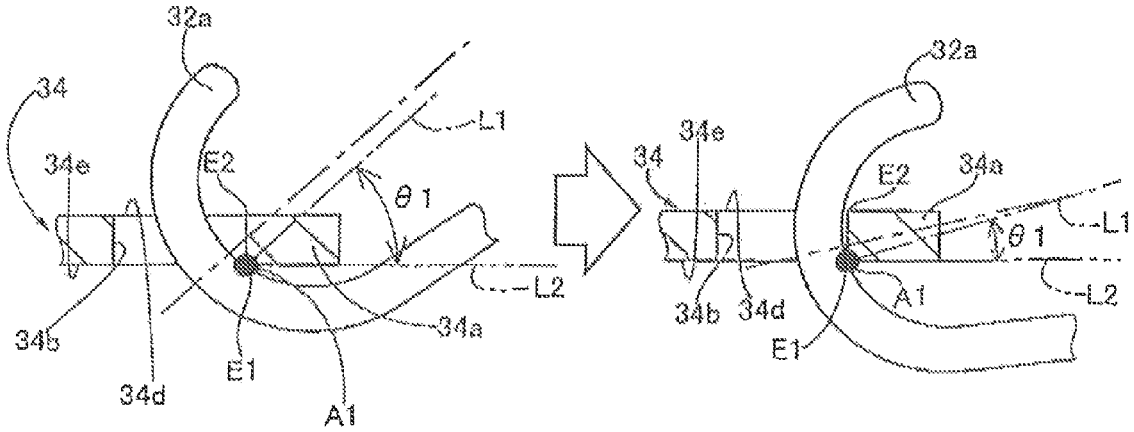
FIG. 3 illustrates views sequentially illustrating the state of the return spring when the operation pedal is depressed so that the pedal stroke becomes maximum, and the state of the return spring when the depression of the operation pedal is cancelled so that the pedal stroke becomes zero, in the brake pedal apparatus of FIG. 1.
Figure 4:
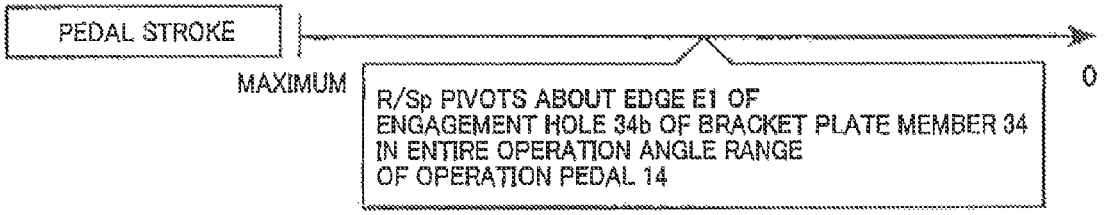
FIG. 4 is a diagram illustrating a movement state of the return spring, which changes in accordance with the depressing operation of the operation pedal in the brake pedal apparatus of FIG. 1.

FIG. 3 illustrates views sequentially illustrating the state of the return spring 32 when the operation pedal 14 is depressed so that the pedal stroke becomes maximum, and the state of the return spring 32 when the depression of the operation pedal 14 is cancelled so that the pedal stroke becomes zero. FIG. 4 is a diagram illustrating a movement state of the return spring 32, which changes in accordance with the depressing operation of the operation pedal. The return spring 32 pivots relative to the operation pedal 14 in accordance with the operation of the operation pedal 14, and pivots about the edge E1 of the engagement hole 34*b* of the bracket plate member 34. That is, the line L1 of action of the return spring 32 pivots relative to the operation pedal 14 about the contact point A1, which is a pivot point, in accordance with the depression of the operation pedal 14 or the cancellation of the operation. Further, as illustrated in FIG. 3, when the pedal stroke is maximum, the contact angle θ1 takes a positive value, and then the contact angle θ1 decreases as the pedal stroke decreases. However, even when the pedal stroke is zero, the contact angle θ1 takes a positive value. That is, the contact angle θ1 takes a positive value in the entire operation angle range of the operation pedal 14. Note that, R/Sp described in FIG. 4 means the return spring 32.

In the state where the pedal stroke is zero at which the operation pedal 14 is at the original position, the contact angle θ1 needs to be larger than zero (θ1>0°) (nominal). However, in consideration of, for example, a dimensional error of each portion of each member of the brake pedal apparatus 10, the contact angle θ1 is preferably larger than five degrees (θ1>5°), and the contact angle θ1 is further preferably larger than ten degrees (θ1>10°). Thus, the direction of the other surface 34*e* of the first plate portion 34*a* of the bracket plate member 34 is set such that the contact angle θ1 has the above-described degree. Further, the contact angle θ1 at the maximum pedal stroke is determined as appropriate in such a range that the engagement hook 32*a* of the return spring 32 is not hooked to the bracket plate member 34.

Next, an influence of variations of dimensions and attachment positions of the components of the brake pedal apparatus 10, such as the operation pedal 14, the bracket plate member 34 and the spring engagement member 36, on the contact angle θ1 will be described with reference to FIG. 1 and FIG. 5.

Figure 5:
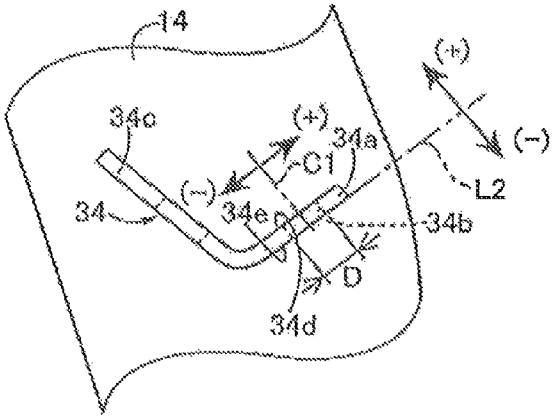
FIG. 5 is a view of an influence of variation of an attachment position of the bracket plate member fixed with the operation pedal, and variation of a position and dimension of the engagement hole of the bracket plate member, on the contact angle.

As illustrated in FIG. 5, when a position of the other surface 34*e* of the first plate portion 34*a* is moved in such a direction as to approach the first support shaft 12 in the thickness direction of the first plate portion 34*a* of the bracket plate member 34, the contact angle θ1 decreases, whereas when the position of the other surface 34*e* is moved in such a direction as to move away from the first support shaft 12, the contact angle θ1 increases. Note that, in FIG. 1, FIG. 5 and FIG. 6, a direction indicated by an arrow with (+) is a direction in which the contact angle θ1 decreases, that is, a direction in which a possibility that abnormal noise will be generated from the return spring 32 during returning pivot motion of the operation pedal 14 increases. Further, a direction indicated by an arrow with (−) is a direction in which the contact angle θ1 increases.

Further, as illustrated in FIG. 5, when a position of an axis C1 of the engagement hole 34*b* of the first plate portion 34*a* is moved in such a direction as to approach the second plate portion 34*c* in a direction perpendicular to the thickness direction of the first plate portion 34*a*, the contact angle θ1 increases, whereas when the position of the axis C1 is moved in such a direction as to move away from the second plate portion 34*c*, the contact angle θ1 decreases. Further, when a hole diameter D of the engagement hole 34*b* increases, the contact angle θ1 increases, whereas when the hole diameter D of the engagement hole 34*b* decreases, the contact angle θ1 decreases.

As illustrated in FIG. 1, when a position of the pedal sheet 24 at the maximum pedal stroke is moved in the depression direction in the thickness direction of the pedal sheet 24 of the operation pedal 14, the contact angle θ1 increases, whereas when the position of the pedal sheet 24 is moved in the direction opposite to the depression direction, the contact angle θ1 decreases. Further, when the other surface 36*d* of the engagement plate portion 36*a* is moved in such a direction as to approach the second support shaft 16 in the thickness direction of the engagement plate portion 36*a* of the spring engagement member 36, the contact angle θ1 increases, whereas when a position of the side surface 36*d* is moved in such a direction as to move away from the second support shaft 16, the contact angle θ1 decreases.

Figure 6:
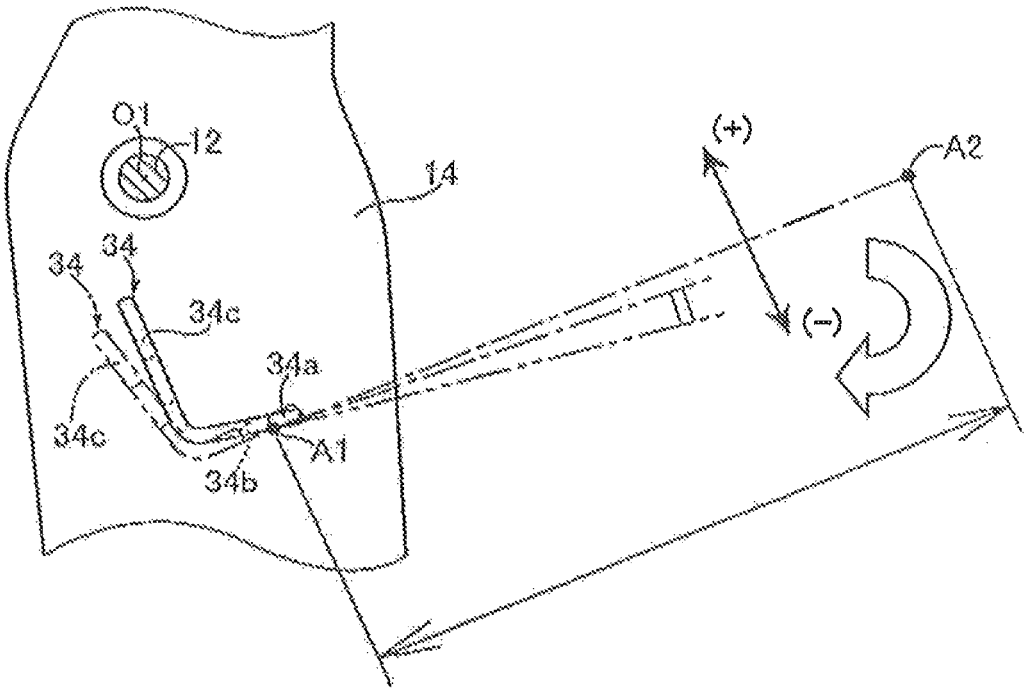
FIG. 6 is a view illustrating a method of tuning the contact angle without exerting the influence on a pedal operation feeling in the case where the dimensions and the attachment positions of the components of the brake pedal apparatus of FIG. 1, such as the operation pedal, the bracket plate member, and the position fixing member vary.

FIG. 6 is an explanatory view of a method of tuning the contact angle θ1 without exerting the influence on a pedal operation feeling in the case where the dimensions and the attachment positions of the operation pedal 14, the bracket plate member 34, and the spring engagement member 36 vary as described above. As illustrated in FIG. 6, even if such variations occur, it is possible to tune the contact angle θ1 without exerting the influence on the pedal operation feeling, only by pivoting an attaching angle of the bracket plate member 34 using the contact point A1 as pivot point.

As described above, in the brake pedal apparatus 10 according to the present embodiment, the surface direction of the other surface 34*e* of the first plate portion 34*a* of the bracket plate member 34, in which the engagement hole 34*b* is formed, is set such that the contact point A1 at which the engagement hook 32*a* contacts the one edge E1 in the pair of the edges E1, E2, which are the ridgelines between the inner wall surface of the engagement hole 34*b* and the other surface 34*e* and the one surface 34*d* of the bracket plate member 34, is the pivot point of the return spring 32 that pivots in accordance with the operation of the operation pedal 14 in the entire operation angle range of the operation pedal 14. Thus, during the returning pivot motion of the operation pedal 14, the contact point A1 at which the engagement hook 32*a* of the return spring 32 contacts the bracket plate member 34 does not shift from the one edge E1 to the other edge E2 in the pair of the edges E1, E2 in the engagement hole 34*b*, and hence discontinuous slip is not generated between the engagement hook 32*a* and the bracket plate member 34. Thus, it is possible to reliably prevent generation of abnormal noise from the return spring 32. Alternatively, during the returning pivot motion of the operation pedal 14, the contact point A1 at which the engagement hook 32*a* of the return spring 32 contacts the bracket plate member 34 does not shift from the one edge E1 to the other edge E2 in the pair of the edges E1, E2 in the engagement hole 34*b*, and hence slip is not generated between the engagement hook 32*a* and the bracket plate member 34. Thus, it is possible to prevent generation of contact noise (knocking noise) that is generated when the engagement hook 32*a* hits the other edge E2 due to abrupt slip.

Further, in the brake pedal apparatus 10 according to the present embodiment, the engagement hole 34*b* is formed so as to pass through the first plate portion 34*a* of the bracket plate member 34 in a direction perpendicular to the other surface 34*e* of the first plate portion 34*a*, and the contact angle θ1 between the surface direction of the other surface 34*e* of the first plate portion 34*a* of the bracket plate member 34, in which the engagement hole 34*b* is formed, and the line L1 of action of the return spring 32, which passes through the contact point A1, takes a positive value in the entire operation angle range of the operation pedal 14. Thus, the contact angle θ1 does not shift from a positive value to a negative value across zero, and a friction force at the contact point A1 is maintained. Therefore, an angle change of the line L1 of action of the return spring 32 along with discontinuous slip of the engagement hook 32*a* is prevented from being inverted from a positive value to a negative value, and thus generation of abnormal noise from the return spring 32 during the returning pivot motion of the operation pedal 14 is reliably prevented. Further, an angle change of the line L1 of action of the return spring 32 along with slip of the engagement hook 32*a* is prevented from being inverted from a positive value to a negative value, and thus the engagement hook 32*a* is prevented from hitting the edge E2. Further, according to the present embodiment, a component for preventing slip between the engagement hook 32*a* and the bracket plate member 34, which becomes a cause for generation of abnormal noise, for example, a component such as a tube or a ring made of a plastic material or rubber need not be attached to the engagement hook 32*a* or the inside of the engagement hole 34*b* of the bracket plate member 34. Therefore, it is not necessary to increase the number of components. As a result, cost reduction is achieved.

Embodiment 2

Next, another embodiment of the invention will be described. Note that in the following description, common portions between the embodiments will be denoted by the same reference symbols and the description thereof will be omitted.

A brake pedal apparatus 38 according to the present embodiment has substantially the same configuration as that of the brake pedal apparatus 10 in the embodiment 1 described above, except that attachment positions of the bracket plate member 34 and the spring engagement member 36, with which the opposite end portions of the return spring 32 are respectively engaged, are different from those in the brake pedal apparatus 10.

Figure 7:
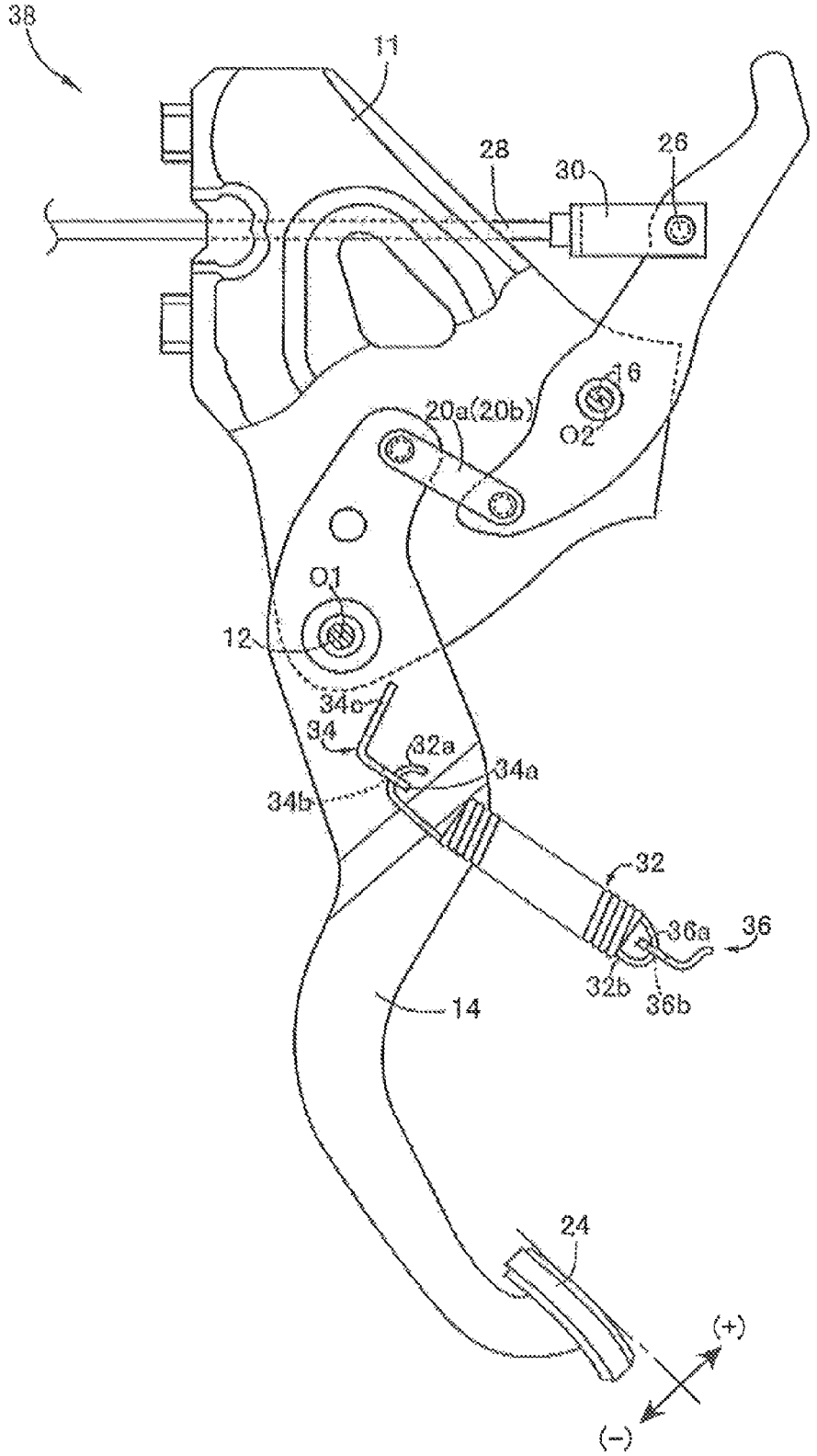
FIG. 7 is a front view of a brake pedal apparatus that is another embodiment of the invention, the view corresponding to FIG. 1.
Figure 8:
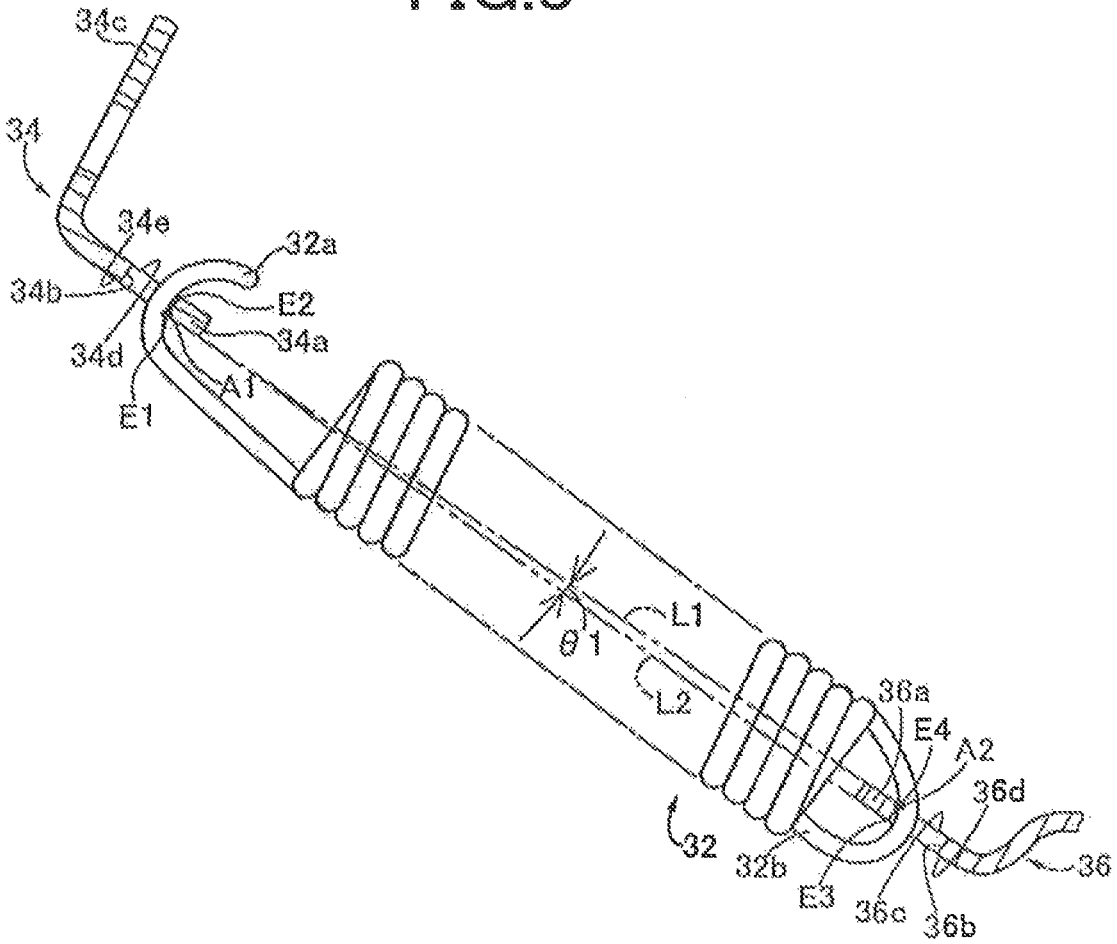
FIG. 8 is a view of a return spring held under tension in the brake pedal apparatus of FIG. 7.
Figure 9:
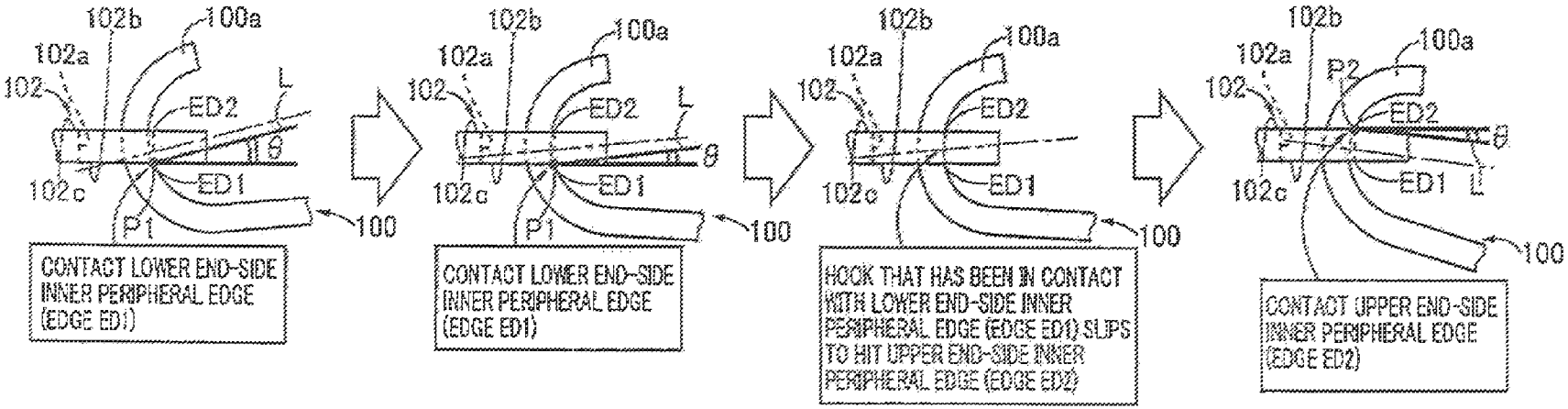
FIG. 9 illustrates view sequentially illustrating the state of the return spring from when the operation pedal is depressed and the pedal stroke becomes maximum until when the depression of the operation pedal is cancelled and the pedal stroke becomes zero, in the conventional brake pedal apparatus.
Figure 10:
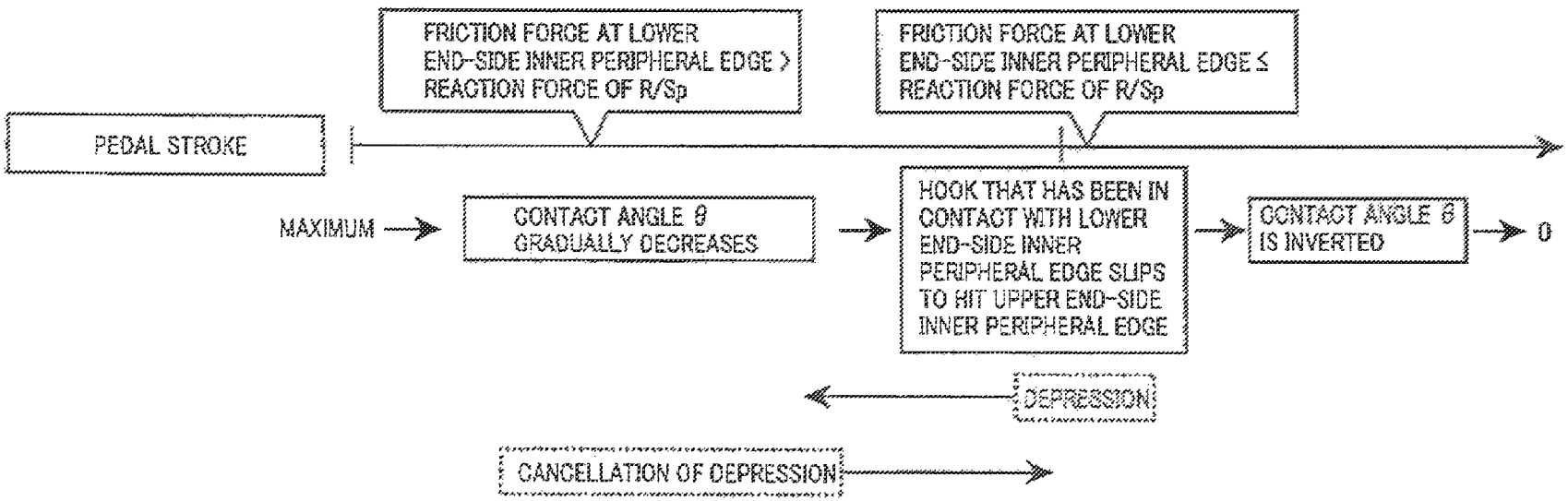
FIG. 10 is a diagram explaining the state where, in the brake pedal apparatus of FIG. 9, a contact angle between the direction of one surface of a bracket plate member and a line of action of the return spring changes in association with a depressing operation of the operation pedal, and a hook slips to hit an upper end-side inner peripheral edge.

As illustrated in FIG. 7 and FIG. 8, the spring engagement member 36 is fixed to a position fixing member (not illustrated) such that the contact point A2 at which the engagement hook 32*b* and the edge E4 of the engagement hole 36*b* contact each other is located below the contact point A1, that is, located closer to the pedal sheet 24 than the contact point A1 is. Further, the surface direction of the other surface 34*e* of the first plate portion 34*a* of the bracket plate member 34 is set such that the degree of the contact angle θ1 takes the same positive value as that of the contact angle θ1 in Embodiment 1 when the pedal stroke is zero, and the bracket plate member 34 is fixed integrally with an intermediate portion of the operation pedal 14.

Thus, in the brake pedal apparatus 38 as well as in the brake pedal apparatus 10 in Embodiment 1, when the pedal stroke is maximum, the contact angle θ1 takes a positive value, and then the contact angle θ1 decreases as the pedal stroke decreases. However, even when the pedal stroke is zero, the contact angle θ1 takes a positive value. That is, the contact angle θ1 takes a positive value in the entire operation angle range of the operation pedal 14. Therefore, the brake pedal apparatus 38 produces effects similar to those of the brake pedal apparatus 10 in Embodiment 1.

In the above, the embodiments of the invention have been described with reference to the drawings, but the invention may be implemented in other modes.

For example, in the brake pedal apparatuses 10, 38 in the above-described embodiments, the circular engagement holes 34*b*, 36*b* are formed respectively in the first plate portion 34*a* of the bracket plate member 34 and the engagement plate portion 36*a* of the spring engagement member 36. However, for example, semicircular cutouts may be formed.

Further, in the brake pedal apparatuses 10, 38 in the above-described embodiments, the surface direction of the other surface 34*e* of the first plate portion 34*a* of the bracket plate member 34 is set such that the contact angle θ1 takes a positive value in the entire operation angle range of the operation pedal 14. However, for example, the surface direction of the other surface 34*e* of the first plate portion 34*a* may be set such that the contact angle θ1 takes a negative value in the entire operation angle range of the operation pedal 14. With this configuration as well, it is possible to produce effects similar to those described above.

Further, in the above-described embodiments, the operation and effect produced in association with a returning operation of the operation pedal 14 has been described, but it is possible to produce similar operation and effect in association with a depressing operation of the operation pedal 14.

Further, in the above-described embodiments, when the engagement hook 32*b* of the return spring 32, which is located on the spring engagement member 36 side, is bent at a curvature radius similar to that of the engagement hook 32*a* located on the bracket plate member 34 side and the contact point A2 at which the engagement hook 32*b* and the spring engagement member 36 contact each other moves in an entire pivot range of the operation pedal 14 to generate discontinuous slip, there is a possibility that the return spring 32 will be vibrated by the discontinuous slip to generate abnormal noise or a possibility that the engagement hook 32*b* will hit the edge E3 to generate contact noise. Therefore, the configuration of the spring engagement member 36 may be similar to that of the bracket plate member 34 located on the engagement hook 32*a* side. That is, the surface direction of the one surface 36*c* or the other surface 36*d* of the portion of the spring engagement member 36, in which the engagement hole 36*b* is formed, may be set such that the contact point A2 at which the spring engagement member 36 contacts the one edge E4 in the pair of the edges E3, E4, which are the ridgelines between the inner wall surface of the engagement hole 36*b* and the one surface 36*c* and the other surface 36*d* of the spring engagement member 36, is the pivot point of the return spring 32 that pivots in accordance with an operation of the operation pedal 14 in the entire operation angle range of the operation pedal 14. In this case as well, during the returning pivot motion of the operation pedal 14, a contact state of the engagement hook 32*b* of the return spring 32 does not shift from the one edge E4 to the other edge E3 in the pair of the edges E3, E4 in the engagement hole 36*b*, and hence discontinuous slip is not generated at the engagement hook 32*a*. Thus, it is possible to reliably prevent generation of abnormal noise from the return spring 32 and to reliably prevent generation of contact noise that is generated when the engagement hook 32*b* hits the other edge E3.

The invention may be implemented in various modes achieved by making various changes and improvements based on the knowledge of a person skilled in the art, although examples of the various modes will not be described.

NOMENCLATURE OF ELEMENTS

10: brake pedal apparatus (vehicle operation pedal apparatus)

11: pedal support (pedal support member)
14: operation pedal
32: return spring
32*a*: engagement hooks
34: bracket plate member
34*b*: engagement hole (hole for engagement)
34*d*: one surface
34*e*: other surface
36: spring engagement member (position fixing member)
36*a*: engagement plate portion
38: brake pedal apparatus (vehicle operation pedal apparatus)
A1: contact point
E1, E2: a pair of edges
L1: line of action of the return spring
O1: axis (one axis)

The invention claimed is:

1. A vehicle operation pedal apparatus comprising an operation pedal supported by a pedal support member so as to be pivotable about one axis, and a return spring having one end portion engaged with a bracket plate member disposed on the operation pedal and an other end portion engaged with a position fixing member, the operation pedal being returned by pivoting in accordance with an urging force of the return spring upon cancellation of a depressing operation of the operation pedal, the vehicle operation pedal apparatus further comprising:

an engagement hook being formed in the one end portion of the return spring, the engagement hook being one bent end portion of a wire rod that constitutes the return spring, and an engagement hole or cutout into which the engagement hook is hooked being formed in the bracket plate member disposed on the operation pedal so as to pass through the bracket plate member, a surface direction of a portion of the bracket plate member, in which the engagement hole or cutout is formed, being set such that a contact point at which the engagement hook contacts one of a pair of edges that are ridgelines between an inner wall surface of the engagement hole or cutout and one surface and an other surface of the bracket plate member is a relative pivot point about which the return spring pivots relative to the operation pedal in accordance with a pivoting operation of the operation pedal in an entire operation angle range of the operation pedal, an angle between the surface direction of the portion of the bracket plate member, in which the engagement hole or cutout is formed, and a line of action of the return spring, which passes through the contact point, taking a positive value in the entire operation angle range of the operation pedal, or taking a negative value in the entire operation angle range of the operation pedal, an engagement hook being formed in the other end portion of the return spring, the engagement hook formed in the other end portion of the return spring being an other bent end portion of the wire rod that constitutes the return spring, and an engagement hole or cutout into which the engagement hook formed in the other end portion of the return spring is hooked being formed in the position fixing member so as to pass through the position fixing member, wherein one of a pair of edges that are ridgelines between an inner wall surface of the engagement hole or cutout and one surface and an other surface of the position fixing member contacts the engagement hook formed in the other end portion of the return spring, and a curvature radius of an arc-shape of a portion of the engagement hook formed in the other end portion of the return spring, which includes a contact point with respect to the engagement hole or cutout formed in the position fixing member, is larger than a curvature radius of an arc-shape of a portion of the engagement hook formed in the one end portion of the return spring, which includes the contact point with respect to the engagement hole or cutout formed in the bracket plate member.

2. The vehicle operation pedal apparatus according to claim 1, wherein the engagement hole or cutout formed in the bracket plate member is formed so as to pass through the bracket plate member in a direction perpendicular to the one surface of the bracket plate member.

3. The vehicle operation pedal apparatus according to claim 1, wherein the engagement hole or cutout formed in the position fixing member is formed so as to pass through the position fixing member in a direction perpendicular to one surface of the position fixing member.

* * * * *